US007026893B2

(12) United States Patent
Kim et al.

(10) Patent No.: US 7,026,893 B2
(45) Date of Patent: Apr. 11, 2006

(54) DIELECTRIC RESONATOR HAVING A MULTILAYER STRUCTURE

(75) Inventors: Bumman Kim, Kyungsangbuk-do (KR); Joung Hyun Yim, Kyungsangbuk-do (KR)

(73) Assignee: Postech Foundation, Kyungsangbuk-do (KR)

( * ) Notice: Subject to any disclaimer, the term of this patent is extended or adjusted under 35 U.S.C. 154(b) by 47 days.

(21) Appl. No.: 10/885,093

(22) Filed: Jul. 7, 2004

(65) Prior Publication Data

US 2005/0140474 A1 Jun. 30, 2005

(30) Foreign Application Priority Data

Dec. 30, 2003 (KR) ..... 10-2003-0100013

(51) Int. Cl.
*H01P 7/10* (2006.01)

(52) U.S. Cl. ..... 333/219.1; 333/202

(58) Field of Classification Search ..... 333/202, 333/219, 219.1

See application file for complete search history.

(56) References Cited

U.S. PATENT DOCUMENTS 4,963,841 A * 10/1990 Sparagna ..... 333/202
6,388,541 B1 * 5/2002 Hiratsuka et al. ..... 333/134
6,480,078 B1 * 11/2002 Kim et al. ..... 333/219.1

* cited by examiner

*Primary Examiner*—Seungsook Ham
(74) *Attorney, Agent, or Firm*—Bacon & Thomas, PLLC

(57) ABSTRACT

A multi-layer dielectric resonant device has a dielectric resonator and a microstrip line to be coupled to the dielectric resonator. The dielectric resonator includes a first dielectric layer, a second dielectric layer, a third dielectric layer, a metallic substrate and a metallic plate. The second dielectric layer is placed on the first dielectric layer and has a dielectric constant higher than that of the first dielectric layer. The third dielectric layer is placed on the second dielectric layer and has a dielectric constant lower than that of the second dielectric layer. The metallic substrate is placed in the center portion of the second dielectric constant layer to reduce the conductor loss of the dielectric resonator. The metallic plate constitutes the outer wall of the dielectric resonator.

6 Claims, 13 Drawing Sheets

FIG.5

| RADIUS(μm) | 1250 | | 1400 | | 1600 | |
|---|---|---|---|---|---|---|
| | F(GHz) | Q factor | F(GHz) | Q factor | F(GHz) | Q factor |
| 2 METAL SUBSTRATES | 36.43 | 2259.2 | 34.09 | 2714.6 | 31.58 | 2882.2 |
| 1 METAL SUBSTRATES | 34.38 | 3425.0 | 32.53 | 3409.5 | 30.54 | 3864.0 |
| METAL SUBSTRATE INSERTED INTO HIGH DIELECTRIC SUBSTRATE | 35.29 | 6388.8 | 33.16 | 5716.8 | 30.95 | 5510.7 |

DIELECTRIC RESONATOR HAVING A MULTILAYER STRUCTURE

FIELD OF THE INVENTION

The present invention relates to a multi-layer dielectric device; and, more particularly, to a multi-layer dielectric resonant device, in which a multilayer dielectric resonator is implemented by stacking low dielectric constant layers and a high dielectric constant layer, and placing a metallic substrate in a center portion of the stacked dielectric layers, and a microstrip line is placed to be coupled to the multilayer dielectric resonator, so that a conductor loss of the device can be reduced and Q factor of the device can be increased.

BACKGROUND OF THE INVENTION

In general, with the increase in demand for exchanges of information via wireless communications, needs for communications systems using microwaves are increasing. Devices used in a wireless communications field tend to have a smaller size and a higher capacity. Furthermore, working frequencies thereof are changed to a high frequency band, and thus the GHz frequency band is being utilized.

Currently, a dielectric material is widely used in a resonator, which is a principal device constituting a part of such a communications system used in such a high frequency band, employing microwaves with a range of 300 MHz to 300 GHz.

FIG. 1 is a perspective view showing a conventional resonant device using a dielectric resonator 14. The dielectric resonator 14 is attached to an upper surface of a dielectric layer 10, and a microstrip line 12 is formed to be spaced apart from the dielectric resonator 14.

The conventional dielectric resonant device of FIG. 1 may be applied to circuits such as a multilayer circuit, an MMIC (monolithic microwave integrated circuit) and a filter to be used in a wireless communication system. However, the conventional dielectric resonant device has a problem in that it is difficult to fabricate the dielectric resonant device to have a high Q factor (quality factor) due to a conductor loss of the microstrip line 12 even though the dielectric resonator 14 has a high Q factor.

Furthermore, in the conventional dielectric resonant device, the dielectric resonator 14, which is separately manufactured, is attached to the dielectric layer 10, so that a problem arises in that it is difficult to miniaturize the dielectric resonant device, and the manufacturing costs thereof are increased.

SUMMARY OF THE INVENTION

It is, therefore, an object of the present invention to provide a multi-layer dielectric resonant device, in which a multilayer dielectric resonator is implemented by stacking low dielectric constant layers and a high dielectric constant layer, and placing a metallic substrate in a center portion of the stacked dielectric layers, and a microstrip line is placed to be coupled to the multilayer dielectric resonator, so that a conductor loss of the device can be reduced, Q value of the device can be increased, and the device using the dielectric resonator can be fabricated with a high degree of integration.

In accordance with a preferred embodiment of the present invention, there is provided a multi-layer dielectric resonant device having a dielectric resonator and a microstrip line to be coupled to the dielectric resonator, the dielectric resonator including: a first dielectric layer having a first dielectric constant; a second dielectric layer having a second dielectric constant higher than the first dielectric constant, which is placed on the first dielectric layer; a third dielectric layer having a third dielectric constant lower than the second dielectric constant, which is placed on the second dielectric layer; a metallic substrate, which is placed in a center portion of the second dielectric layer, for reducing a conductor loss of the dielectric resonator; and a metallic plate for surrounding the first, second and third dielectric layers, thereby forming an outer wall of the dielectric resonator.

In accordance with another preferred embodiment of the present invention, there is provided a multi-layer dielectric resonant device having a dielectric resonator and a microstrip line to be coupled to the dielectric resonator, the dielectric resonator including: a first dielectric layer having a first dielectric constant; a second dielectric constant layer having a second dielectric constant, which is placed on the first dielectric layer and provided with a hole at a center portion thereof; a third dielectric layer having a third dielectric constant higher than the first and second dielectric constants, which is placed within the hole of the second dielectric layer and on the first dielectric layer; a fourth dielectric layer having a fourth dielectric constant lower than the third dielectric constant, which is placed on the second dielectric layer and the third dielectric layer; a metallic substrate, which is placed in a center portion of the second dielectric layer, for reducing conductor loss of the dielectric resonator; and a metallic plate for surrounding the first, second, third and fourth dielectric layers, thereby forming an outer wall of the dielectric resonator.

BRIEF DESCRIPTION OF THE DRAWINGS

The above and other objects and features of the present invention will become apparent from the following description of preferred embodiments given in conjunction with the accompanying drawings, in which:

FIG. 5 exhibits a table showing variations of a resonance frequency and Q factor of a dielectric resonator depending on the number and positions of metallic substrates to be placed therein;

DETAILED DESCRIPTION OF THE PREFERRED EMBODIMENTS

Preferred embodiments of the present invention are described in detail with reference to the accompanying drawings below.

Figure 1:
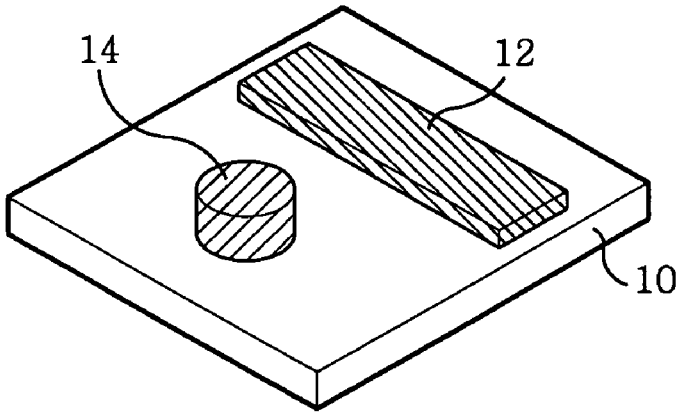
FIG. 1 (PRIOR ART)
FIG. 1 is a perspective view showing a conventional resonant device.
Figure 2:
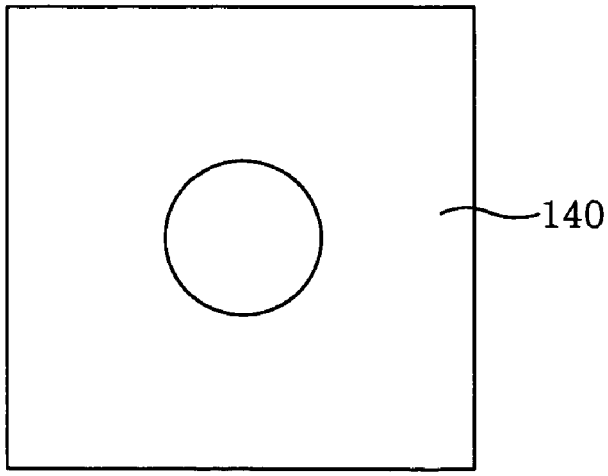
FIG. 2 is a plan view showing a metallic substrate to be placed in a multilayer dielectric resonator in accordance with the present invention.

FIG. 2 illustrates a plan view of a metallic substrate 140 to be placed in a multilayer dielectric resonator in accordance with the present invention. In the metallic substrate 140, a circular hole is formed at a center portion thereof. By placing the metallic substrate 140 in a center portion of dielectric layers stacked in the multi-layer dielectric resonator, a conductor loss of the multilayer dielectric resonator can be reduced.

Figure 3A:
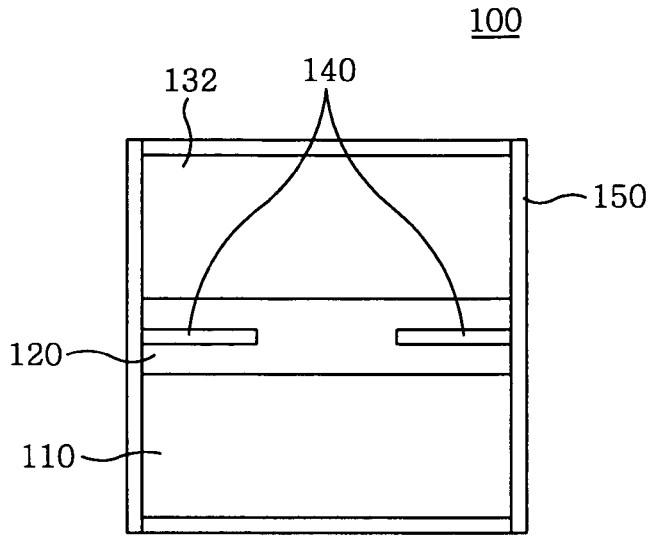
FIG. 3A is a cross-sectional view showing a multi-layer dielectric resonator in accordance with a first embodiment of the present invention.

FIG. 3A shows a cross-sectional view of a multi-layer dielectric resonator 100 in accordance with a first embodiment of the present invention. The multilayer dielectric resonator 100 includes a first dielectric layer 110 having a first dielectric constant, a second dielectric layer 120 having a second dielectric constant higher than the first dielectric constant, which is placed on the first dielectric layer 110, a third dielectric layer 132 having a third dielectric constant lower than the second dielectric constant, which is placed on the second dielectric layer 120, a metallic substrate 140, which is placed in a center portion of the second dielectric layer 120, to reduce a conductor loss of the dielectric resonator 100, and a metallic plate 150 for forming an outer wall of the dielectric resonator 100 and blocks loss attributable to an RF wave radiation of a microstrip line to be coupled to the dielectric resonator 100.

In this embodiment, the first and third dielectric layers 110 and 132 may contain LTCC (low temperature co-fired ceramic) having a dielectric constant of about 5.6, and the second dielectric layer 120 may contain LTCC having a dielectric constant of about 40.0.

The metallic substrate 140 is placed in the second dielectric layer 120, preferably, in the center portion of the second dielectric layer 120, which functions to confine electromagnetic waves within the second dielectric layer 120, and thus reduce the conductor loss of a dielectric resonant device including the dielectric resonator 100 compared to the conventional dielectric resonant device, thereby allowing the dielectric resonant device to have a high Q value.

Figure 4A:
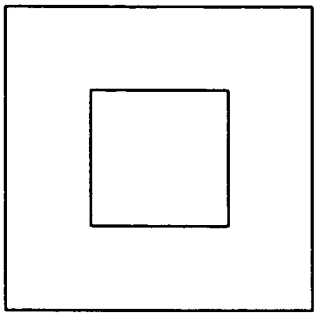
FIGS. 4A to 4C are plan views showing various examples of metallic substrates to be placed in a multi-layer dielectric resonator in accordance with the present invention.
Figure 4B:
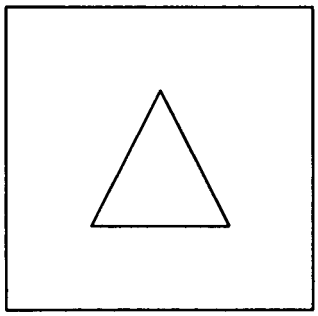
Figure 4C:
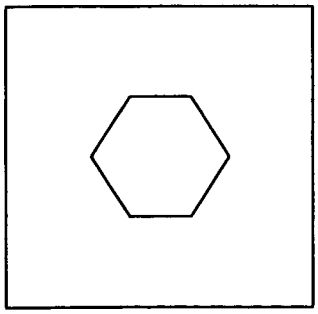

The metallic substrate 140 can be made of any conductive material such as gold, silver, aluminum or copper. Furthermore, although the metallic substrate 140 has been described to have the circular hole formed therein in FIG. 2, metallic substrates 140 having a rectangular hole, a triangular hole and a hexagonal hole, respectively, as depicted in FIGS. 4A to 4C, can be employed in the dielectric resonator 100.

The Q value of the dielectric resonator 100 shown in FIG. 3A can be calculated using Eq. (1).

$$\frac{1}{Q_u} = \frac{(P_r + P_d + P_c)}{2\pi f W} = \frac{1}{Q_r} + \frac{1}{Q_d} + \frac{1}{Q_c} \qquad \text{Eq. (1)}$$

where $Q_r$ is a Q value related to radiation loss, $Q_d$ is a Q value attributable to dielectric loss, and $Q_c$ is a Q value attributable to conductor loss. Additionally, in Eq. (1), $P_r$ is power loss due to radiation loss, $P_d$ is power loss due to dielectric loss, $P_c$ is power loss due to conductor loss, W is a maximum amount of energy stored in the dielectric resonator in a single period of resonance, and f is a resonance frequency of the dielectric resonator.

In Eq. (1), $Q_r$ may be considered to be zero because it has a value much smaller than those attributable to the other losses due to the blocking of radiation by a metallic plate of the dielectric resonator. Therefore, $Q_c$ and $Q_d$ mainly influence the Q value. As a result, the dielectric resonator of the present invention can achieve a high Q value because its conductor loss is very small and almost only dielectric loss remains in the dielectric resonator of the present invention, whereas the conventional resonator using a ¼ λ microstrip line achieves a small Q value due to relatively large conductor loss as well as dielectric loss.

Figure 3B:
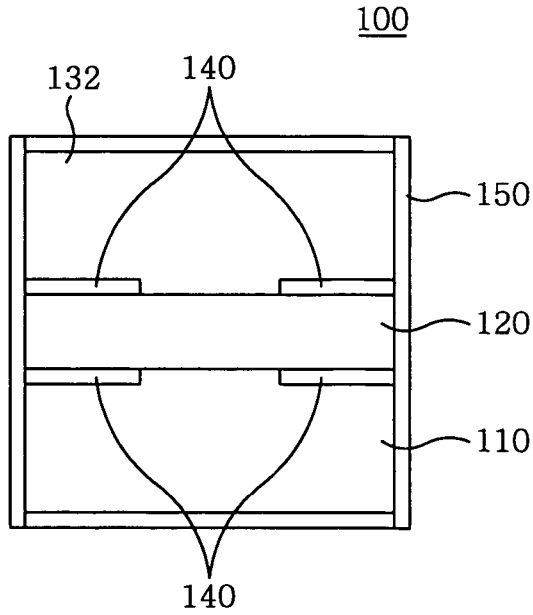
FIG. 3B is a cross-sectional view showing a dielectric resonator in which two metallic substrates are placed on upper and lower surfaces of a high dielectric constant layer.
Figure 3C:
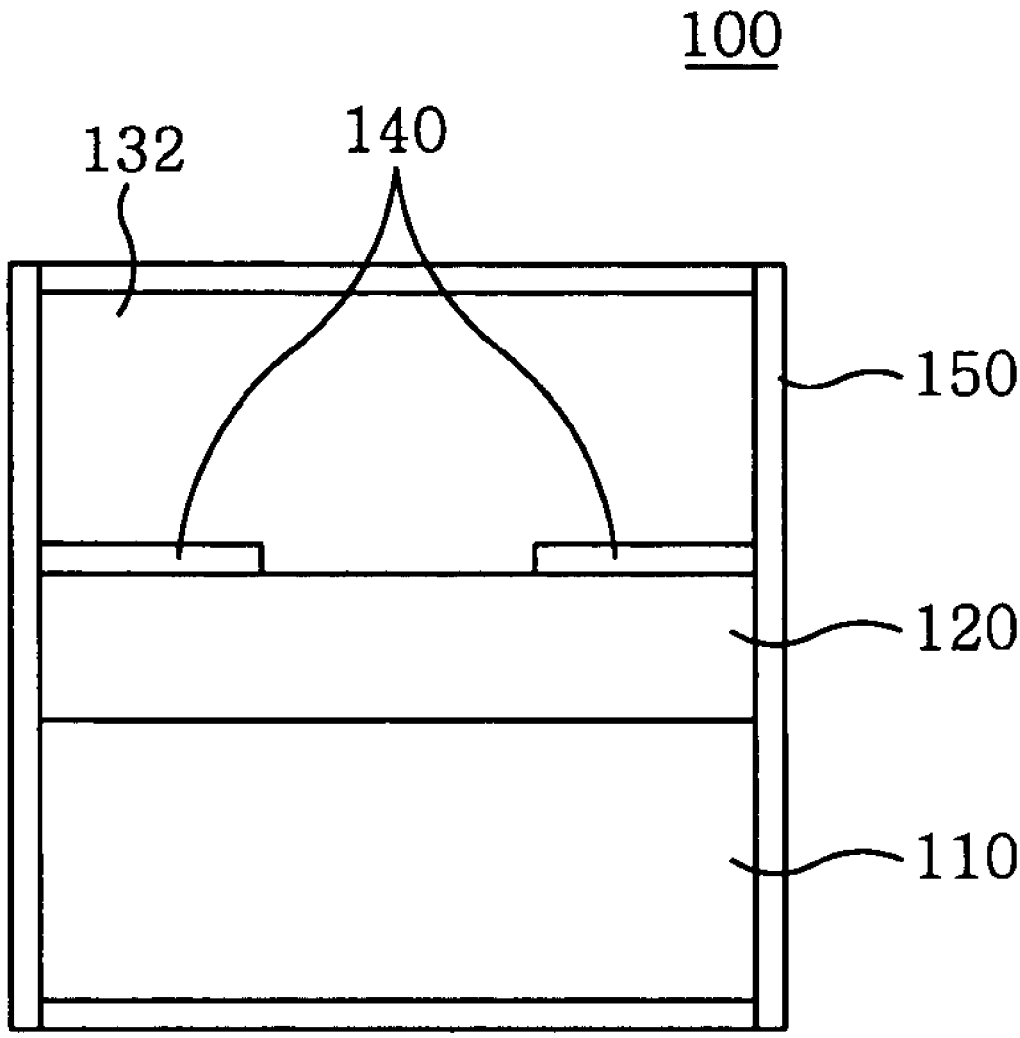
FIG. 3C is a cross-sectional view showing a dielectric resonator in which a single metallic substrate is placed on an upper or a lower surface of a high dielectric constant layer.

FIG. 5 charts a table showing variations of a resonance frequency and Q value depending on the number and positions of metallic substrates to be formed in dielectric resonators as shown in FIGS. 3A to 3C. The table of FIG. 5 shows results obtained by calculating resonance frequencies and Q values of the dielectric resonators using a simulation tool, wherein first and third dielectric layers 110 and 132 have a dielectric constant of 5.6 and a thickness of 700 μm, a second dielectric layer 120 has a dielectric constant of 40.0 and a thickness of 300 μm, and a metallic substrate 140 made of silver has a hole of a radius of 1250 μm. Referring to FIG. 5, compared to a dielectric resonator in which two metallic substrates 140 are placed on upper and lower surfaces of a second dielectric layer 120, respectively, as shown in FIG. 3B, a dielectric resonator in which a single metallic substrate 140 is placed on an upper or a lower surface of a second dielectric layer 120 as shown in FIG. 3C has a higher Q value. Further, the dielectric resonator in accordance with the first embodiment of the present invention, in which the single metallic substrate 140 is placed in the center of the second dielectric layer 120, as shown in FIG. 3A, has a Q value two times higher than that of the dielectric resonator in which the single metallic substrate 140 is placed on the upper or lower surface of the second dielectric layer 120, as shown in FIG. 3C.

Figure 6:
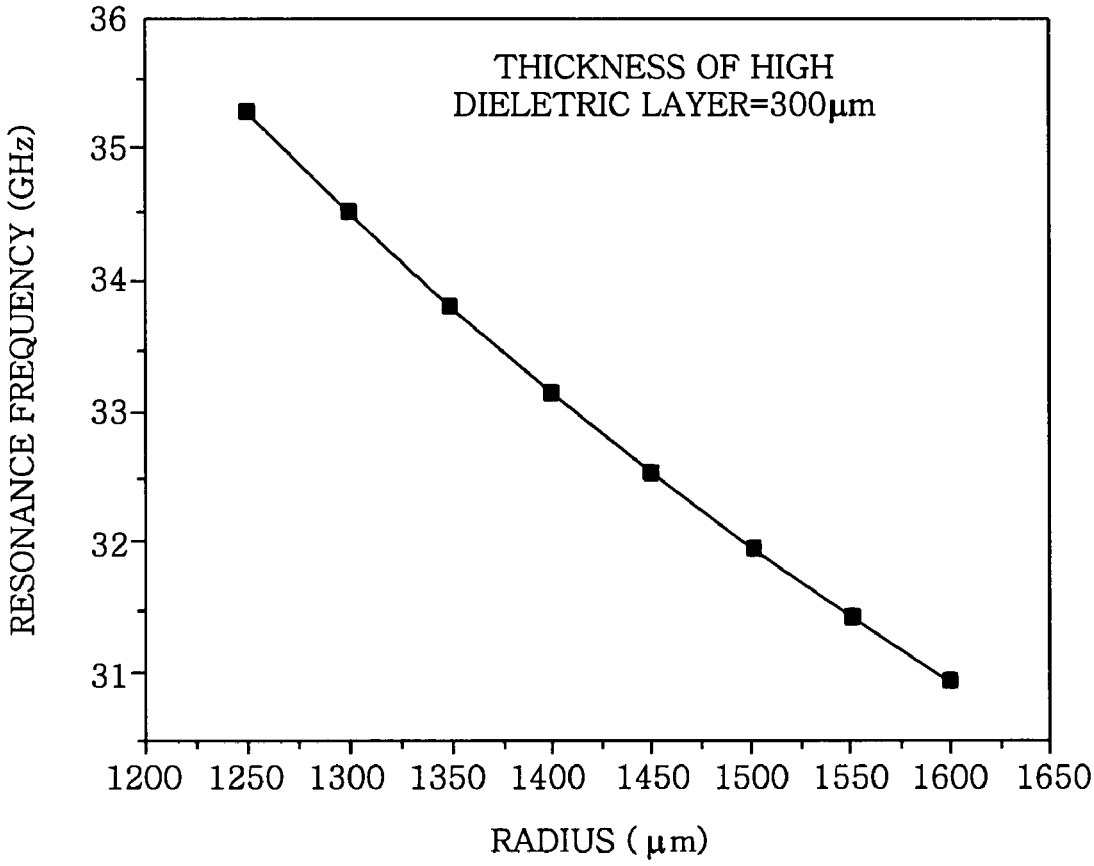
FIG. 6 illustrates a graph showing variations of a resonance frequency depending on variations of a radius of a hole of a metallic substrate to be placed in a dielectric resonator in accordance with the present invention.
Figure 7:
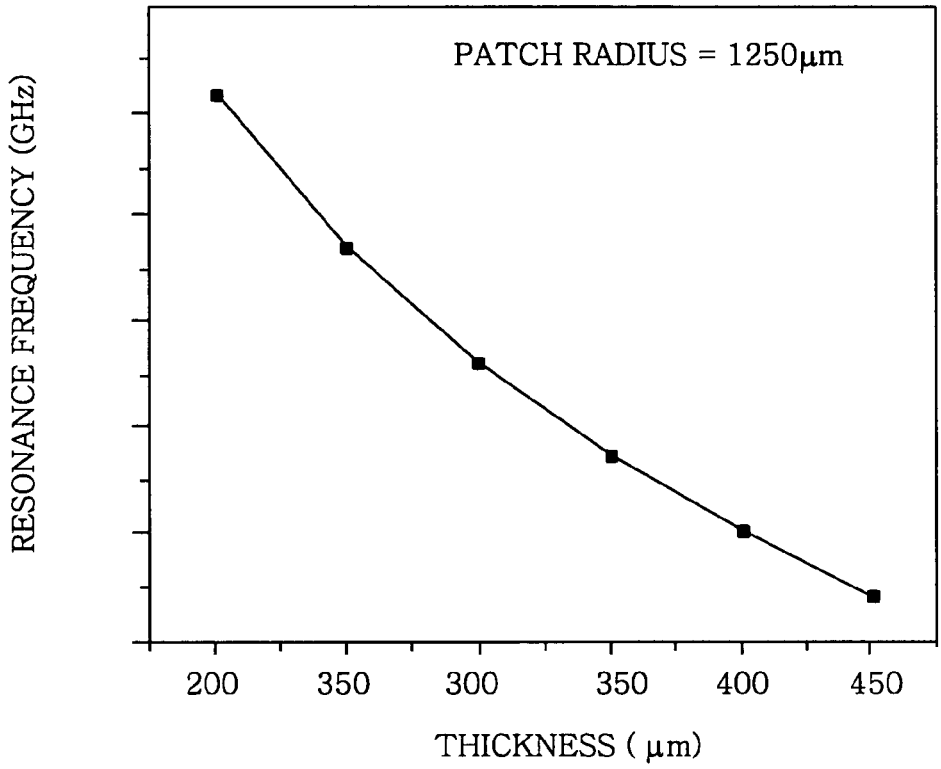
FIG. 7 depicts a graph showing variations of a resonance frequency depending on variations of a thickness of a high dielectric constant layer included in a dielectric resonator in accordance with the present invention.

In the meantime, in the dielectric resonator of the present invention, its resonance frequency can be set to a desired value by adjusting the radius of the hole of the metallic substrate 140 or the thickness of the second dielectric layer 120. FIGS. 6 and 7 show examples of varying resonance frequencies by adjusting the radius of the hole of the metallic substrate 140 and the thickness of the second dielectric layer 120 in the dielectric resonator of the present invention, respectively.

FIG. 6 shows a graph illustrating variations of a resonance frequency depending on variations of the radius of the hole of the metallic substrate 140 placed in the dielectric resonator as shown in FIG. 3A, wherein the first and third dielectric layers 110 and 132 each have a dielectric constant of 5.6, and the second dielectric layer 120 has a dielectric constant of 40.0. Furthermore, the thickness of the first and third dielectric layers 110 and 132 is 700 μm, the thickness of the second dielectric layer 120 is 300 μm, and the thickness of the metallic substrate 140 is 10 μm. Referring to FIG. 6, it is found that, as the radius of the circular hole of the metallic substrate 140 formed at the center of the second dielectric layer 120 increases, a resonance frequency of the resonator decreases.

FIG. 7 depicts a graph showing variations of a resonance frequency depending on variations of a thickness of the second dielectric layer 120 placed in the dielectric resonator of the present invention as shown in FIG. 3A, wherein, the radius of the hole of the metallic substrate 140 is fixed to 1250 μm, the thickness of the first and third dielectric layers 110 and 132 is 700 μm, the thickness of the second dielectric layer 120 varies within a range of 200–450 μm, and the thickness of the metallic substrate 140 is 10 μm. As illustrated in the graph of FIG. 7, it is found that, in case the thickness of the first and third dielectric layers 110 and 132 is constant, the resonance frequency of the dielectric resonator decreases as the thickness of the second dielectric layer 120 increases.

Figure 8:
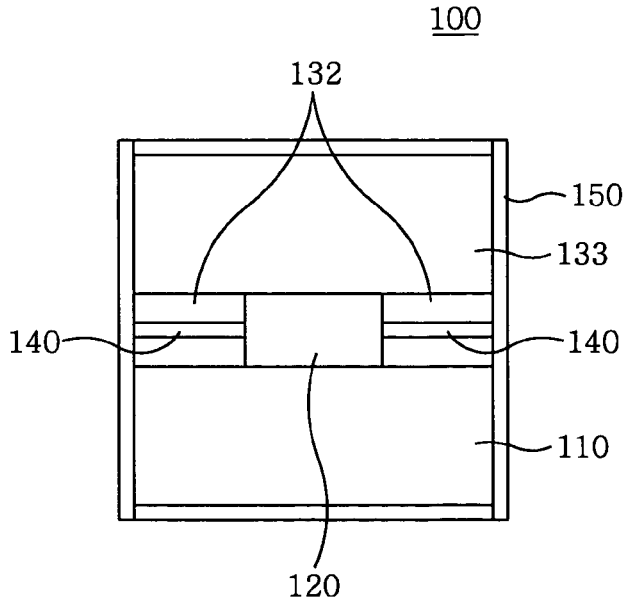
FIG. 8 provides a cross-sectional view showing a multi-layer dielectric resonator in accordance with a second embodiment of the present invention.

FIG. 8 exhibits a dielectric resonator 100 in accordance with a second embodiment of the present invention. Referring to FIG. 8, the dielectric resonator 100 includes a first dielectric layer 110 having a first dielectric constant, a third dielectric layer 132 having a third dielectric constant, which is placed on the first dielectric layer 110, a second dielectric layer 120 having a second dielectric constant higher than the first and third dielectric constant, which is placed within a center hole of the third dielectric layer 132 and on the first dielectric layer 110, a fourth dielectric layer 133 having a fourth dielectric constant lower than the second dielectric constant, which is placed on the third dielectric layer 132 and the second dielectric layer 120, a metallic substrate 140 that is placed in the center portion of the third dielectric layer 132 to reduce a conductor loss of the dielectric resonator 100, and a metallic plate 150 that constitutes an outer wall of the dielectric resonator 100 and blocks loss attributable to an RF wave radiation of a microstrip line to be coupled to the dielectric resonator 100.

In this embodiment, the metallic substrate 140 is placed in the third dielectric layer 132, preferably, in the center portion of the third dielectric layer 132, such that the metallic substrate 140 surrounds the second dielectric layer 120. The metallic substrate 140 functions to confine electromagnetic waves within the third dielectric layer 132, and thus reduce the conductor loss of a dielectric resonant device including the dielectric resonator 100 compared to the conventional dielectric resonant device, thereby allowing the dielectric resonant device to have a high Q value.

As described in the first embodiment, the metallic substrate 140 can be made of any conductive material such as gold, silver, aluminum or copper. Furthermore, the metallic substrate 140 may be implemented to have a hole of various shapes such as a circular hole, a rectangular hole, a triangular hole and a hexagonal hole, as depicted in FIGS. 4A to 4C.

Figure 9A:
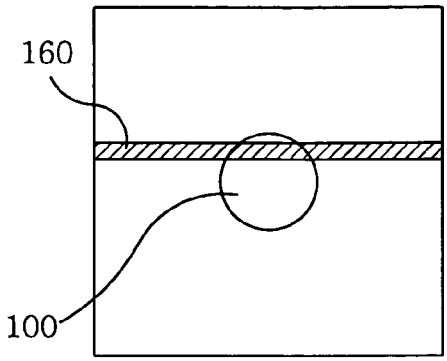
FIGS. 9A to 9C depict plan views showing a coupling between dielectric resonators and microstrip lines in accordance with the present invention.
Figure 9B:
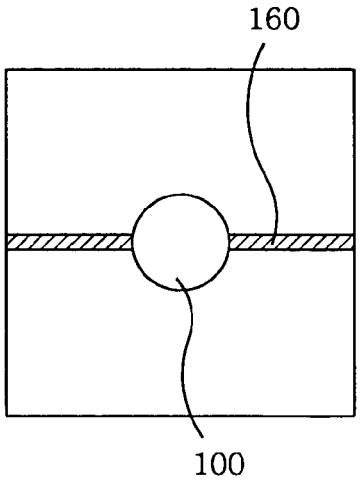
Figure 9C:
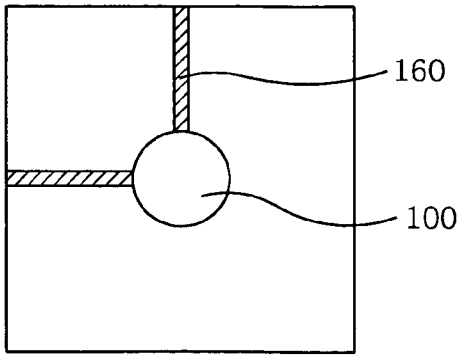

FIGS. 9A to 9C depicts plan views of dielectric resonant devices showing a coupling between dielectric resonators 100 and microstrip lines 160 in accordance with the present invention. Although the dielectric resonators 100 have been illustrated as having circular shapes, it is possible to implement the dielectric resonators 100 in other shapes, such as rectangular and hexagonal shapes. Referring to FIGS. 9A to 9C, the microstrip line 160 may be constructed in a straight line shape that passes above a dielectric resonator 100 as shown in FIG. 9A, in a straight line shape that passes through a dielectric resonator 100 as shown in FIG. 9B, or in a rightangled line shape that passes through a dielectric resonator 100 as shown in FIG. 9C. Although the microstrip lines 160 constructed only in non-curved line shapes have been illustrated in FIGS. 9A to 9C, it is possible to implement microstrip lines in various shapes, including a curved shape.

Figure 10A:
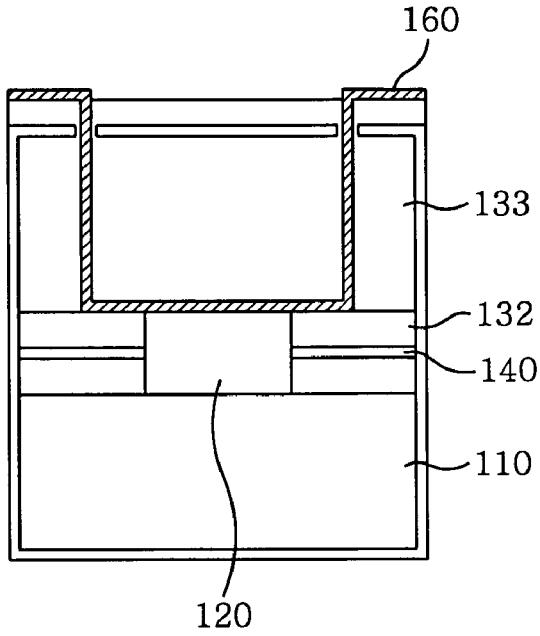
FIGS. 10A to 10D are cross-sectional views showing a coupling between dielectric resonators and microstrip lines in accordance with the present invention.
Figure 10B:
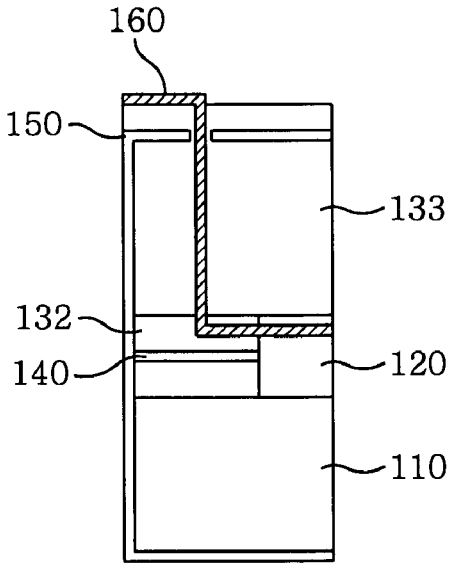
Figure 10C:
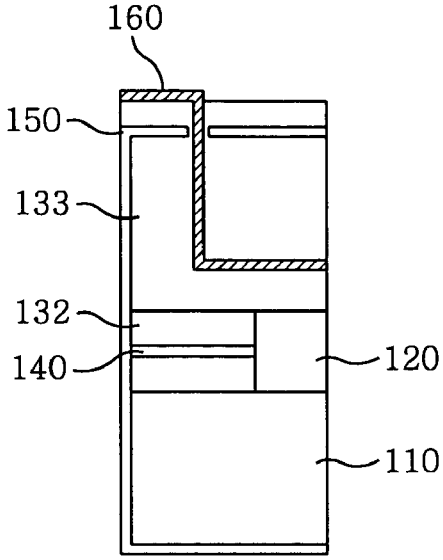
Figure 10D:
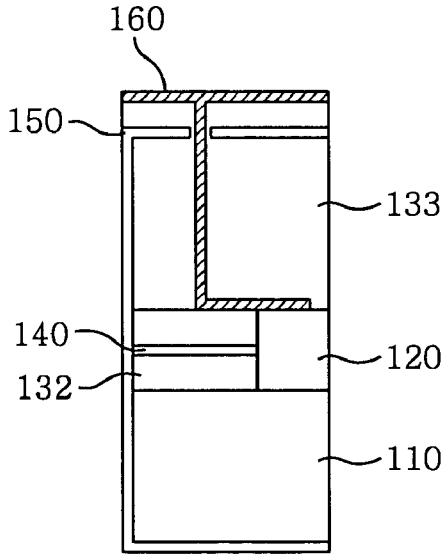

FIGS. 10A to 10D illustrates cross-sectional views of dielectric resonant devices showing a coupling between dielectric resonators and microstrip lines in accordance with the present invention. In particular, FIGS. 10B to 10D show sections of left portions of symmetrical dielectric resonant devices. Since a liquid dielectric material may be used to implement the dielectric resonator of the present invention, a microstrip line 160 is readily anywhere in the dielectric resonator, e.g., immediately above a second dielectric layer 120, in the second dielectric layer 120, or to be spaced apart from the second dielectric layer 120. That is, to increase the effect of the coupling between a dielectric resonator and a microstrip line 160, the microstrip line 160 is preferably located immediately above or in the second dielectric layer 120, as shown in FIGS. 10A, 10B and 10D. In contrast, to reduce the effect of the coupling between a dielectric resonator and a microstrip line 160, the microstrip line 160 is placed at a location that is spaced apart from a second dielectric layer 120, as shown in FIG. 10C.

Figure 11A:
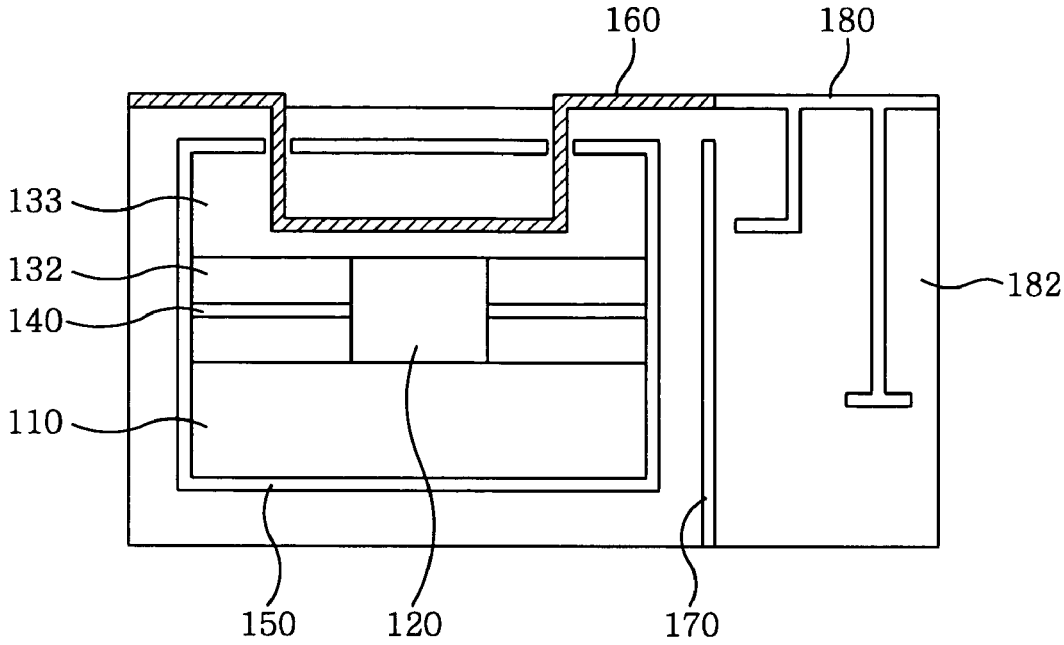
FIGS. 11A to 11C illustrate cross-sectional views of dielectric resonant devices connected to circuits adjacent to the devices in accordance with the present invention.
Figure 11B:
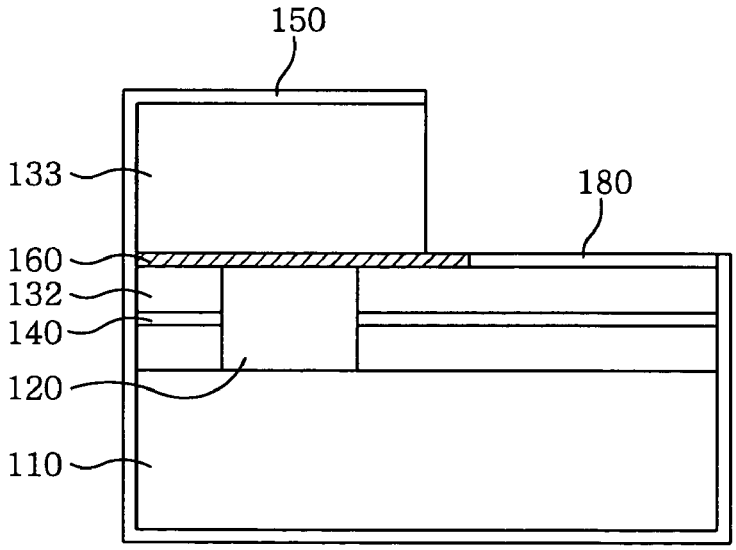
Figure 11C:
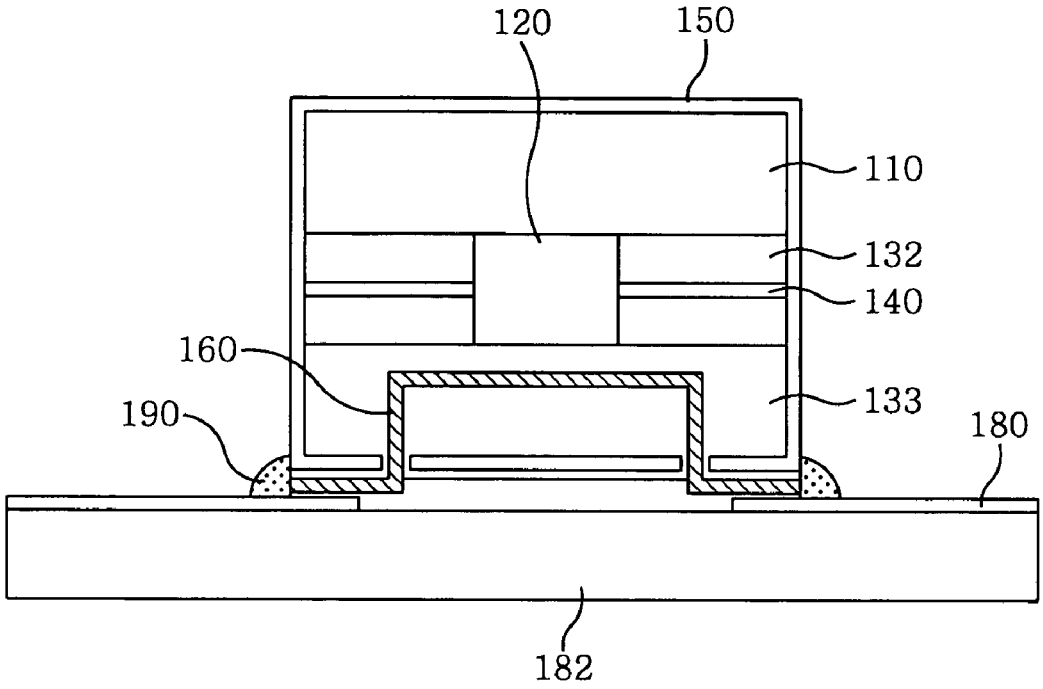

FIGS. 11A to 11C shows dielectric resonant devices connected to other adjacent circuits in accordance with the present invention.

As shown in FIG. 11A, a dielectric resonant device in accordance with the present invention may be connected to an adjacent circuit 180 by connecting an end of microstrip line 160 to a wire of the circuit 180. In this case, the dielectric resonant device and the circuit 180 may be implemented in a single substrate 182. Further, the circuit 180 may be isolated from the dielectric resonant device by a barrier, which is formed, e.g., by arranging a series of via holes in the substrate 182, such that an electromagnetic wave generated by the dielectric resonant device cannot affect the circuit 180.

FIG. 11B illustrates a monolithic circuit wherein a circuit 180 is included within a metallic plate 150 of a dielectric resonant device in accordance with the present invention. In this case, a microstrip line 160 is implemented as a part of the circuit 180.

Further, as shown in FIG. 11C, a dielectric resonant device in accordance with the present invention may be mounted on a circuit 180 of a substrate 182 through a solder 190. In this case, the dielectric resonant device is fabricated separately from the circuit 180.

Figure 12A:
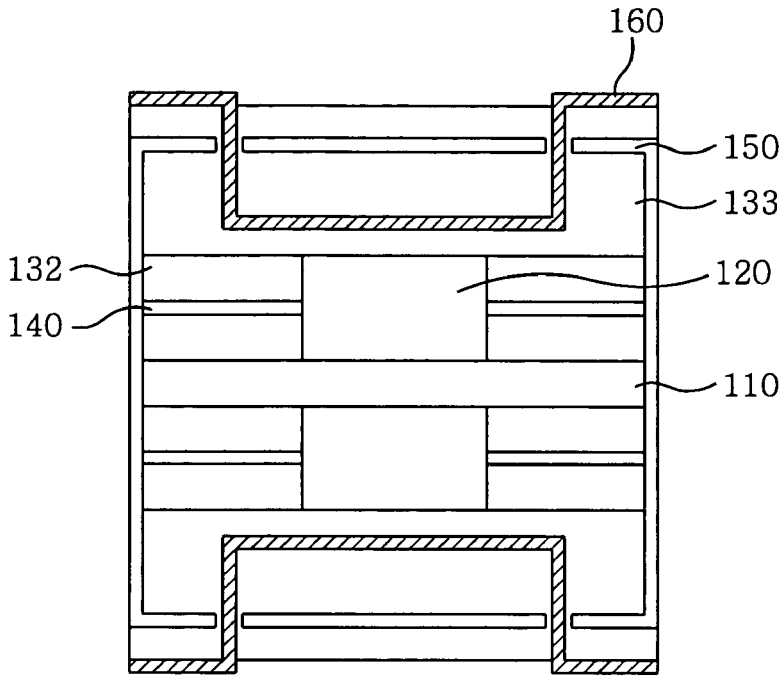
FIGS. 12A and 12B show resonant filters each using two dielectric resonant devices in accordance with the present invention.
Figure 12B:
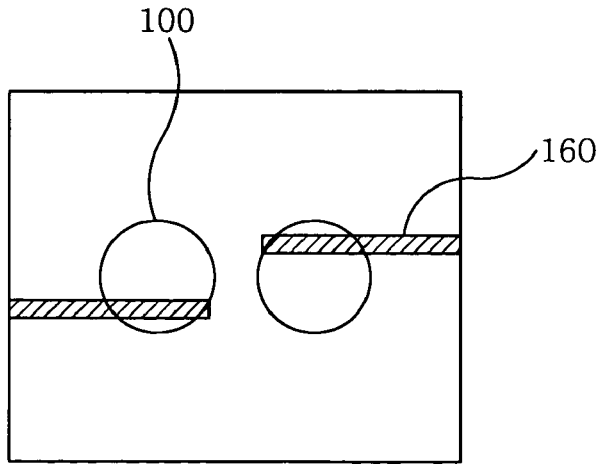

FIGS. 12A and 12B show resonant filters employing dielectric resonant devices in accordance with the present invention. A filter may be implemented in a vertical arrangement in which two dielectric resonant devices are stacked one on top of another, as shown in FIG. 12A, or in a horizontal arrangement in which two dielectric resonant devices are arranged side-by-side with each other. Although the resonant filters, in each of which two resonant devices in accordance with the present invention are vertically or horizontally arranged, have been illustrated in FIGS. 12A and 12B, respectively, it is possible to vertically or horizontally arrange three or more dielectric resonant devices in a single filter. By fabricating a filter using a single multilayer dielectric resonant devices or a plurality of multilayer dielectric resonant devices connected to each other, it is possible to fabricate a filter having a high Q value, which may be, e.g., a band-pass filter or a band-stop filter to be used in a mobile communication device.

As described above, in accordance with the present invention, a multi-layer dielectric resonator is implemented by stacking dielectric layers, including low dielectric constant layers and a high dielectric constant layer, and placing a metallic substrate in the center portion of the stacked dielectric layers, and a microstrip line is placed to be coupled to the multilayer dielectric resonator, so that a conductor loss of the multi-layer dielectric resonator can be reduced and its Q value can be increased. Further, a device employing the dielectric resonator of the present invention can be fabricated with a high degree of integration.

While the invention has been shown and described with respect to the preferred embodiments, it will be understood by those skilled in the art that various changes and modifications may be made without departing from the spirit and scope of the invention as defined in the following claims.

What is claimed is:

1. A multi-layer dielectric resonant device having a dielectric resonator and a microstrip line to be coupled to the dielectric resonator, the dielectric resonator comprising:

a first dielectric layer having a first dielectric constant;

a second dielectric layer having a second dielectric constant higher than the first dielectric constant, which is placed on the first dielectric layer;

a third dielectric layer having a third dielectric constant lower than the second dielectric constant, which is placed on the second dielectric layer;

a metallic substrate, which is placed in a center portion of the second dielectric layer, for reducing a conductor loss of the dielectric resonator; and a metallic plate for surrounding the first, second and third dielectric layers, thereby forming an outer wall of the dielectric resonator.

2. The device of claim 1, wherein the metallic substrate is provided with a hole at a center portion thereof.

3. The device of claim 2, wherein the hole of the metallic substrate has one of circular, elliptical and polygonal shapes.

4. A multi-layer dielectric resonant device having a dielectric resonator and a microstrip line to be coupled to the dielectric resonator, the dielectric resonator comprising:

a first dielectric layer having a first dielectric constant;

a second dielectric constant layer having a second dielectric constant, which is placed on the first dielectric layer and provided with a hole at a center portion thereof;

a third dielectric layer having a third dielectric constant higher than the first and second dielectric constants, which is placed within the hole of the second dielectric layer and on the first dielectric layer;

a fourth dielectric layer having a fourth dielectric constant lower than the third dielectric constant, which is placed on the second dielectric layer and the third dielectric layer;

a metallic substrate, which is placed in a center portion of the second dielectric layer, for reducing conductor loss of the dielectric resonator; and a metallic plate for surrounding the first, second, third and fourth dielectric layers, thereby forming an outer wall of the dielectric resonator.

5. The device of claim 4, wherein the metallic substrate is provided with a hole at a center portion thereof.

6. The device of claim 5, wherein the hole of the metallic substrate has one of circular, elliptical and polygonal shapes.

* * * * *